US008429863B2

(12) United States Patent
Poniros

(10) Patent No.: US 8,429,863 B2
(45) Date of Patent: Apr. 30, 2013

(54) PREFABRICATED FRAME SUPPORT

(76) Inventor: John M. Poniros, Mamaroneck, NY (US)

( * ) Notice: Subject to any disclaimer, the term of this patent is extended or adjusted under 35 U.S.C. 154(b) by 0 days.

(21) Appl. No.: 12/764,625

(22) Filed: Apr. 21, 2010

(65) Prior Publication Data

US 2011/0258950 A1 Oct. 27, 2011

(51) Int. Cl.
*E04B 1/00* (2006.01)

(52) U.S. Cl.
USPC ..... 52/279; 52/262; 52/481.1; 52/715

(58) Field of Classification Search ..... 52/272, 52/262, 279, 210, 481.1, 702, 712, 92.2, 52/698, 704, 708, 715, 703
See application file for complete search history.

(56) References Cited

U.S. PATENT DOCUMENTS

| | | | | |
|---|---|---|---|---|
| 2,010,294 | A | 5/1933 | Lovell | |
| 2,796,158 | A | 6/1957 | Miles et al. | |
| 3,188,696 | A * | 6/1965 | Earhart | 52/241 |
| 3,363,377 | A * | 1/1968 | Beckman | 52/275 |
| 3,901,471 | A | 8/1975 | Hilgers | |
| 3,989,399 | A | 11/1976 | Slowbe | |
| 5,600,924 | A | 2/1997 | Forsberg | |
| 6,088,982 | A * | 7/2000 | Hiesberger | 52/241 |
| 6,405,507 | B1 * | 6/2002 | Milton et al. | 52/846 |
| 6,682,814 | B2 * | 1/2004 | Hendrickson et al. | 428/326 |
| 7,299,593 | B1 | 11/2007 | diGirolamo et al. | |
| 7,331,148 | B2 | 2/2008 | Di Lorenzo | |
| 2004/0103610 | A1 * | 6/2004 | Axsom | 52/481.1 |
| 2007/0193143 | A1 * | 8/2007 | Antonic | 52/241 |
| 2008/0236071 | A1 | 10/2008 | Surowiecki et al. | |
| 2009/0056242 | A1 | 3/2009 | Dubreuil | |
| 2009/0255198 | A1 | 10/2009 | Kozel et al. | |

FOREIGN PATENT DOCUMENTS

WO WO-01/39969 A1 6/2001

OTHER PUBLICATIONS

International Search Authority, US, PCT International Search Report dated Jun. 27, 2011.

* cited by examiner

*Primary Examiner* — William Gilbert
*Assistant Examiner* — Gisele Ford
(74) *Attorney, Agent, or Firm* — Schiff Hardin LLP

(57) ABSTRACT

A support frame for supporting an intersection between a first wall section and a second wall section. The support frame including a first support panel having a top edge and a bottom edge, which are configured to be positioned between respective upper and lower plates of the first wall section. Moreover, the support frame has a pair of second support panels affixed to the first panel, and each second support panel has a top edge and a bottom edge configured to be positioned between respective upper and lower plates of the second wall section.

21 Claims, 4 Drawing Sheets

PREFABRICATED FRAME SUPPORT

TECHNICAL FIELD

The present invention relates generally to wall framing, and more particularly to a prefabricated frame support structure designed to be interposed between two wall sections intersecting one another at approximately a 90° angle.

BACKGROUND OF THE INVENTION

During construction of residential homes and similar buildings, it is common practice to construct framing assemblies for intersecting walls at the site of the construction. FIGS. 1 and 2, for example, illustrate conventional designs for framing assemblies interposed between two wall sections adjoining one another at a T-shaped intersection.

As shown in FIG. 1, a primary wall A having a lower plate 12 intersects with an intersecting wall B having a lower plate 14. During construction, a 2×6 backing stud 16 is position on lower plate 12 and provided for corner nailing. Moreover, a 2×4 end stud 18 is then attached to the 2×6 backing stud 16 and positioned on lower plate 14. The combination of the two studs (i.e., 2×6 backing stud 16 and 2×4 end stud 18) forms the frame support for the T-intersection between primary wall A and intersecting wall B.

As further shown in FIG. 2, a primary wall A having a lower plate 12 again intersects with an intersecting wall B having a lower plate 14. In this design, a 2×4 backing stud 20 is positioned during construction on lower plate 12 and a 2×4 end stud 22 is then attached to the 2×6 backing stud 20 and positioned on lower plate 14. A pair of additional 2×4 studs 24*a* and 24*b* are secured to the respective sides of backing stud 20 and serve as a means for corner nailing.

There are numerous disadvantages and drawbacks to these types framing assemblies for T-intersections. First, the basic approaches illustrated in FIGS. 1 and 2 require more material than is necessary to carry the imposed loads. Furthermore, fabrication of these framing assemblies at the construction site is quite inefficient and time consuming. Virgin lumber and scraps are often used to construct these frame assemblies during construction. Consequently, due to the extra material used and the labor required at the construction site, one can expect the total cost of such framing assemblies to be relatively high.

SUMMARY OF THE INVENTION

Accordingly, the present invention presents a prefabricated or premanufactured T-intersection frame structure that is designed to overcome the disadvantages and drawbacks of conventional on-site constructed T-intersection framing assemblies. Generally in the design disclosed herein, the present invention provides a support frame for supporting an intersection between a first wall section and a second wall section. The support frame including a first support panel having a top edge and a bottom edge, which are configured to be positioned between respective upper and lower plates of the first wall section. Moreover, the support frame has a pair of second support panels affixed to the first panel, and each second support panel has a top edge and a bottom edge configured to be positioned between respective upper and lower plates of the second wall section.

DETAILED DESCRIPTION OF THE INVENTION

Figure 1:
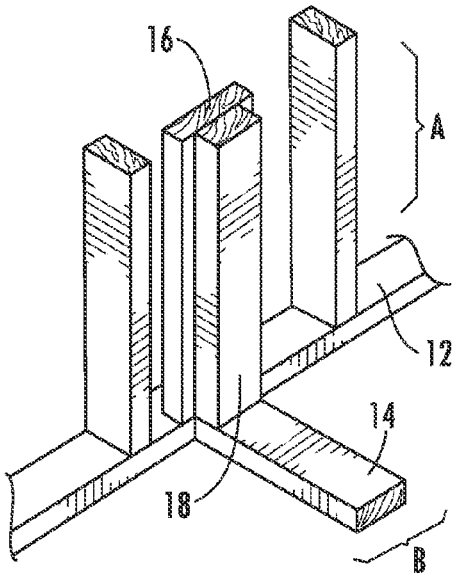
FIG. 1 PRIOR ART
FIG. 1 illustrates a conventional design for framing assemblies interposed between two wall sections adjoining one another at a T-shaped intersection.
Figure 2:
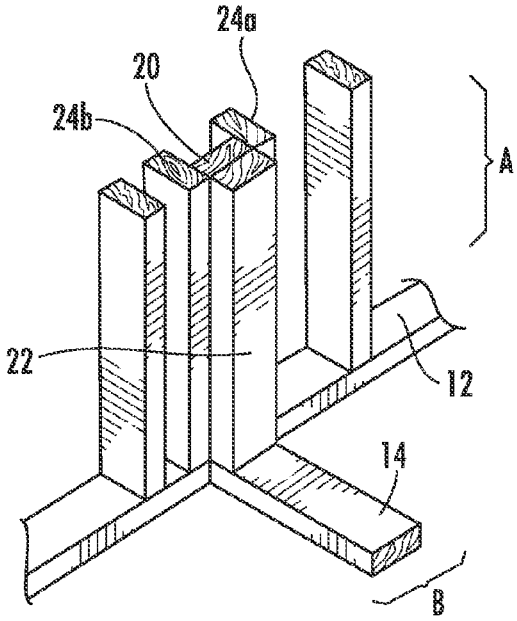
FIG. 2 PRIOR ART
FIG. 2 illustrates another conventional design for framing assemblies interposed between two wall sections adjoining one another at a T-shaped intersection.
Figure 3:
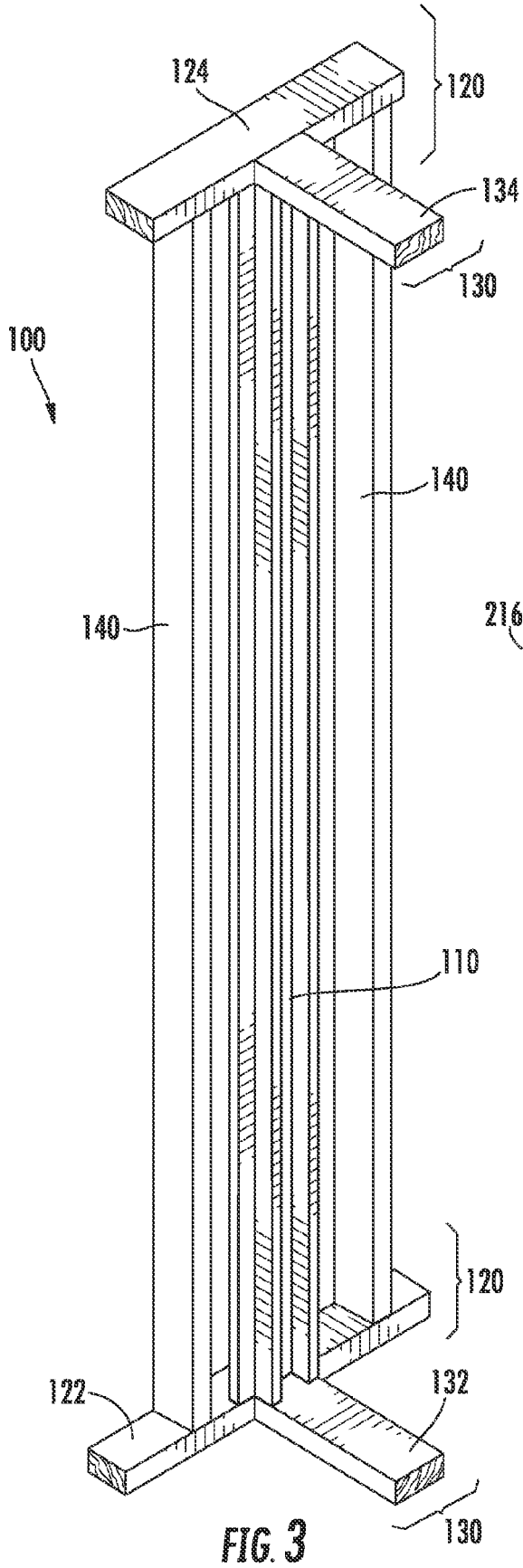
FIG. 3 illustrates a perspective of two wall sections connected to one another by the frame structure in accordance with an exemplary embodiment.

FIG. 3 illustrates a perspective 100 of two wall sections connected to one another by the frame structure in accordance with an exemplary embodiment of the present invention. It should be readily apparent that the two wall sections can represent any intersecting wall sections in any building. In the exemplary embodiment, the intersection is a T-intersection where the pair of wall sections intersect at an approximately 90° angle. Specifically, as shown, frame structure 110 is interposed between first wall section 120 and second wall section 130. Wall section 120 further includes lower plate 122, upper plate 124 and a plurality of studs 140 connected between lower plate 122 and upper plate 124. One skilled in the art would appreciate that the lower and upper plates are typically conventional 2×4 studs or 2×6 studs. It should also be clear that the studs 140 that are provided are approximately the desired height of the wall of the building being constructed. Moreover, wall section 130 further includes lower plate 132, upper plate 134 and a plurality of studs (not shown) connected between lower plate 132 and upper plate 134. As will be explained in more detail below, frame structure 110 is interposed between the two wall sections 120, 130 to facilitate construction of the wall intersection.

Figure 4:
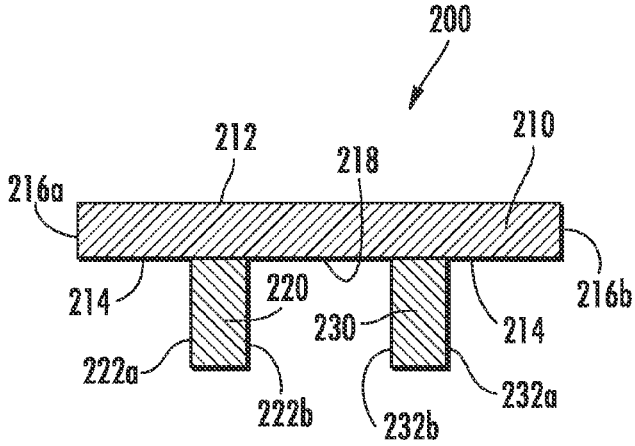
FIG. 4 illustrates a cross-sectional view of the frame structure in accordance with an exemplary embodiment.

FIG. 4 illustrates a cross-sectional view of frame structure 200 in accordance with an exemplary embodiment. It should be understood that frame structure 200 provides a cross-sectional view of frame structure 110 illustrated in FIG. 3. As shown, frame structure 200 comprises a first support panel 210 having two opposing sides 212 and 214 and two outer edges 216*a* and 216*b*. In the exemplary embodiment, first support panel 210 is substantially rectangular in shape. Furthermore, frame structure 200 comprises two individual second support panels 220, 230 that protrude from side 214 of first panel 210 at an approximately 90° angle. As such, the pair of individual second support panels 220, 230 are positioned substantially parallel to one another. In the exemplary embodiment, the pair of second support panels 220, 230 are also substantially rectangular in shape. Moreover, the pair of second support panels 220 and 230 each have respective outer sides 222*a* and 232*a*, respective inner sides 222*b* and 232*b*, as well as respective ends 224 and 234. In the exemplary embodiment, frame structure 200 is therefore formed with a recess 218 between inner sides 222*b* and 232*b* of second support panels 220 and 230. It should be clear that while the exemplary embodiment is illustrate with second support panels 220 and 230 being secured to first support panel 210 at a 90° angle, the application is in no way intended to be limited to such implementation. It is envisioned that alternative angles are possible pending on the particular design of the building being constructed.

In implementation, the pair of second support panels 220 and 230 are secured to first support panel 210 by any applicable means. For example, second support panels 220, 230 can be secured to first support panel 210 by nails, adhesive, screws, a combination of these materials, or any other suitable means. In an alternative implementation, second support panels 220, 230 are manufactured as a single piece of material with first support panel 210. Frame structure 200 can be manufactured from recycled material, plywood, chipboard, or any other suitable material. In one embodiment, the individual support panels, 210, 220 and 230 of frame structure 200 can be milled out of plywood and connected with a suitable adhesive.

As explained above and illustrated in FIG. 3, frame structure 200 is interposed between wall section 120 and wall section 130 during construction. It is appreciated that frame structure 200 is inserted between lower plates 122, 132 and upper plates 124, 134 of walls sections 120 and 130, respectively. Accordingly, in implementation, frame structure 200 will be substantially the same length as the plurality of studs 140 shown in FIG. 3.

Figure 5:
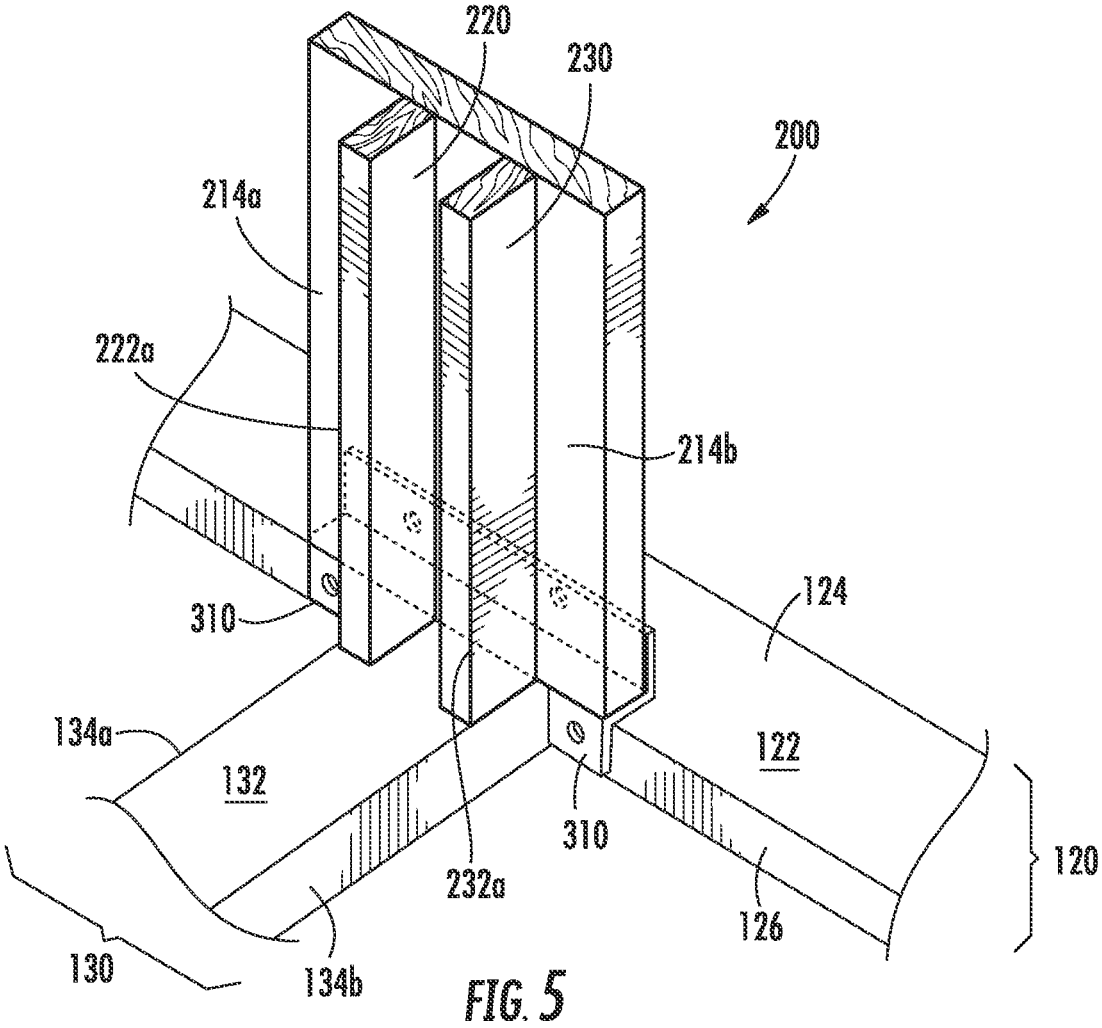
FIG. 5 illustrates a side partial view of the frame structure interposed between the two wall sections in accordance with an exemplary embodiment.

FIG. 5 illustrates a side partial view of frame structure 200 interposed between the two wall sections in accordance with an exemplary embodiment. As shown, frame structure 200 is coupled to the upper surface 124 of lower plate 122 of wall section 120 by connector bracket 310. It should be appreciated that connector bracket 310 can be any conventional bracket capable of connecting frame structure 200 and lower plate 122 and is not limited to the design illustrated in FIG. 5. Furthermore, frame structure 200 is secured to lower plate 122 such that the inner sides 214*a*, 214*b* of frame structure 200 are in substantially the same plane as side edge 126 of lower plate 122. Furthermore, the pair of second support panels 220, 230 of frame structure 200 are secured to first support panel 210 with a premeasured width such that outer sides 222*a* and 232*a* are in substantially the same plane as the side edges 134*a*, 134*b* of lower plate 132 of wall section 130. Alternatively, second support panels, 220 and 230 can be positioned closer together (e.g., 1 inch apart). Finally, while not shown, it should be appreciate that the opposite end of frame structure 200 is secured to the upper plates 124, 134 of wall sections 120, 130 in a substantially similar manner.

Once secured between wall sections 120 and 130, frame structure 200 is properly positioned to support the load imposed upon the intersection areas of the respective wall structure. In this regard, it is appreciated that first support panel 210 as well as the pair of second support panels 220, 230 are designed so as to assume the principal load carrying function.

To facilitate construction and design of the particular building, it is appreciated that the inner sides 214*a*, 214*b* of first support panel 210 serve to receive the inner wall structure of the house for wall section 120, such as sheetrock, paneling, etc. Similarly, in the exemplary embodiment, the outer sides or edges 212 of first support panel 210 can server to receive the outer side wall structure of the building such as exterior paneling, siding, etc. Moreover, the outer sides 222*a* and 232*a* of the pair of respective second support panels 220 and 230 serve to receive the inner wall structure of the house for wall section 130, such as sheetrock, paneling, etc. It should be appreciated that sheetrock, paneling, siding, etc. are attached to the support panels by, screws, nails, adhesive, or any other suitable means.

Figure 6:
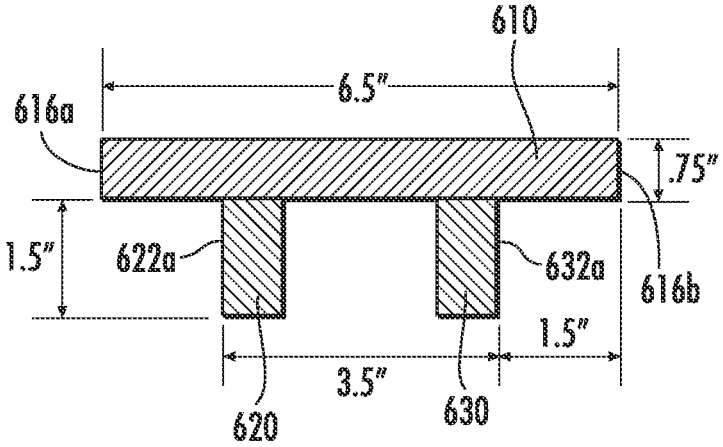
FIG. 6 illustrates a cross-sectional view of the frame structure in accordance with an exemplary embodiment.

FIG. 6 illustrates a cross-sectional view of frame structure 600 in which specific dimensions are provided in accordance with an exemplary embodiment. As shown, first support panel 610 has a length of approximately 6½ inches and a width of approximately ¾ inches. Moreover, the pair of second support panels 620 and 630 have a length of approximately 1½ inches. Further, second support panels 620 and 630 are secured to first support panel 610 such that their respective outer surfaces 622*a* and 632*a* are positioned approximately 1½ inches from the respective outer edges 616*a* and 616*b* of first support panel 610. As a result, there is sufficient space provided by frame structure 600 enabling sheetrock, paneling, and the like to be secured to inner sides 614*a* and 614*b* of first support panel 610 as well as to the respective outer surfaces 622*a* and 632*a* of second support panels 620 and 630. It should be appreciated, however, that the second support panels 620 and 630 can be shorter than 1½ inches (e.g., 1 inch) or longer as needed, so long as sufficient space is provided for finishing materials, such as sheetrock, to be attached. It is reiterated that while these dimensions are provided for the embodiment illustrated in FIG. 6, the invention is by no means intended to be limited by these dimensions.

Figure 7:
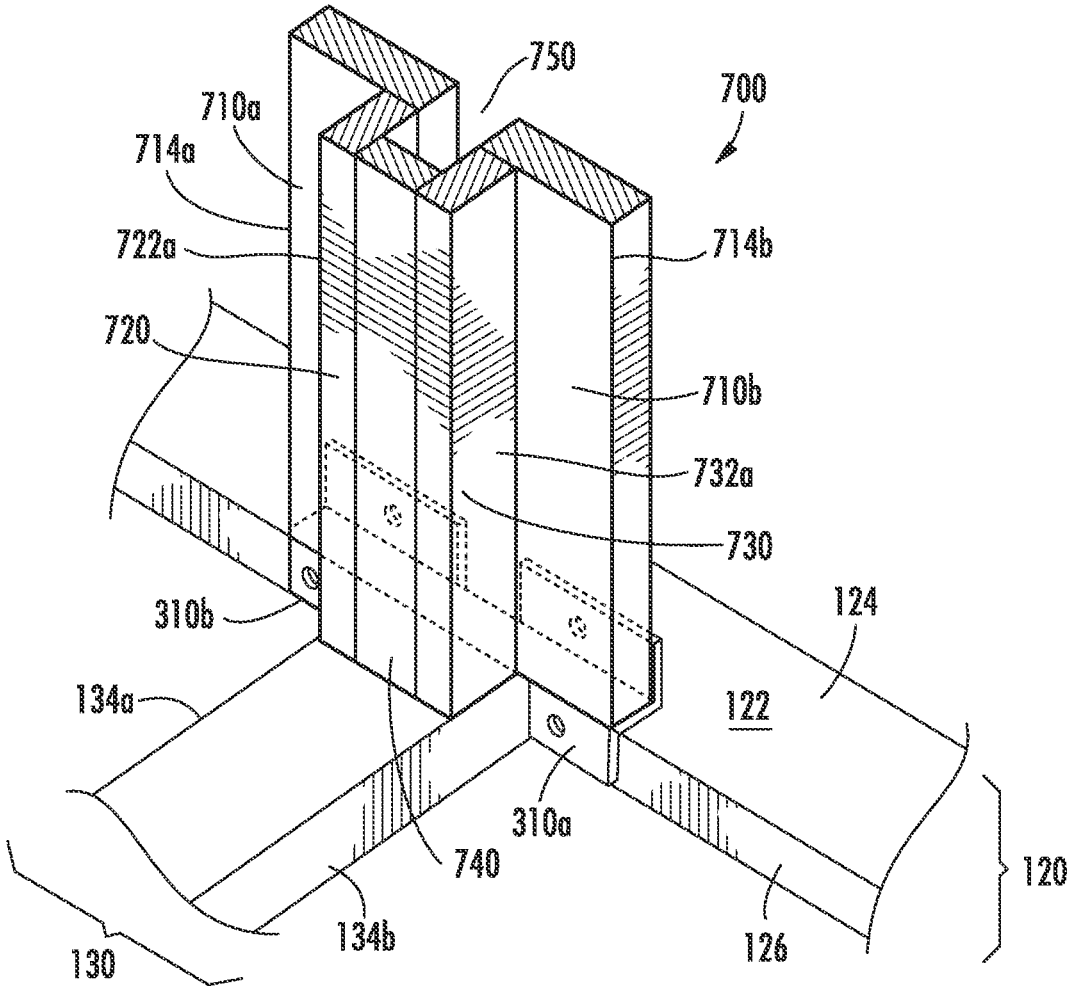
FIG. 7 illustrates a side partial view of the frame structure interposed between the two wall sections in accordance with another exemplary embodiment.

FIG. 7 illustrates a side partial view of frame structure 700 interposed between two wall sections 120, 130 in accordance with another exemplary embodiment. In contrast to the embodiments described above, frame structure 700 comprises a pair of first support panels 710*a*, 710*b*. Moreover a pair of second support panels 720 and 730 are secured, respectively, to the pair of first support panels 710*a*, 710*b*. Additionally, a third support panel 740 can be secured between the pair of second support panels 720 and 730. As such, a recess 750 is provided between second support panels 720 and 730. In one embodiment, second support panels 720 and 730 as well as third support panel 740 are prefabricated as a single piece of material. In any event, it should be appreciated that frame structure 700 comprises similar functional aspects as frame structure 200. For example, in a similar manner as shown in FIG. 5, the pair of first support panels 710*a* and 710*b* are coupled to the upper surface 124 of lower plate 122 of wall section 120 by a pair connector bracket 310*a*, 310*b*. Furthermore, frame structure 700 is secured to lower plate 122 such that the respective inner sides 714*a* and 714*b* of the pair of first support panels 710*a* and 710*b* are in substantially the same plane as side edge 126 of lower plate 122. Furthermore, the pair of second support panels 720, 730 are secured to the pair of first support panels 710*a* and 710*b* with a premeasured width such that outer sides 722*a* and 732*a* are in substantially the same plane as the side edges 134*a*, 134*b* of lower plate 132 of wall section 130.

It is appreciated that the frame structures of the present invention can be particularly designed and dimensioned for walls of various thickness. For example, the frame structures of the present invention can include pre-drilled holes to facilitate easy installation during building construction. In addition, it is further contemplated that the exemplary frame structures of the present invention can easily and conveniently be prefabricated or premanufactured from various suitable materials as discussed above. It is therefore appreciated that the frame structure inserts or assemblies have the capability of reducing both material and the labor cost over conventional construction techniques for the T-intersection framing structure used within framed walls of residential structures and the like as well as any other structure/wall that can utilize the T-intersection framing design. In addition, the design of the present invention enables the T-intersection to be easily insulated and in fact improves the resistance of the wall structure by reducing heat losses and gains to the interior of the structure. Also, as explained above, the frame structures of the present invention provide an attachment surface for the full height of inside and outside wall coverings about the framed intersection.

Figure 8:
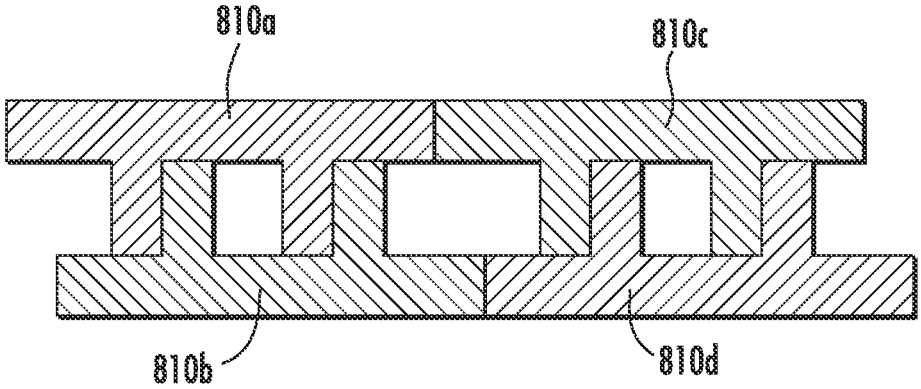
FIG. 8 illustrate an advantageous shipping configuration of T-intersection frame structures in accordance with an exemplary embodiment.

Finally, FIG. 8 illustrates an advantageous shipping configuration of the frame structures in accordance with an exemplary embodiment. As shown, a plurality of frame structures 810*a*-810*d* can be stacked in an efficient manner are shown in FIG. 8. It should be clear that the plurality of frame structures 810*a*-810*d* employ the same design as the exemplary structure described above with respect to FIG. 3-5. Accordingly, in addition to the foregoing advantages described above, the exemplary frame structure enables this further benefit to aid the construction of a building.

While the foregoing has been described in conjunction with an exemplary embodiment, it is understood that the term "exemplary" is merely meant as an example, rather than the best or optimal. Accordingly, the application is intended to cover alternatives, modifications and equivalents, which may be included within the spirit and scope of the invention.

Additionally, in the preceding detailed description, numerous specific details have been set forth in order to provide a thorough understanding of the present invention. However, it should be apparent to one of ordinary skill in the art that the inventive test circuit may be practiced without these specific details. In other instances, well-known methods, procedures, components, and circuits have not been described in detail so as not to unnecessarily obscure aspects of the application.

What is claimed is:

1. A frame for providing an intersection between a first wall section and a second wall section, said frame comprising:

a single first support panel having a top edge and a bottom edge configured to be positioned between an upper plate and a lower plate of the first wall section; and a pair of second support panels connected to and extending outward from a first surface of the single first support panel, the first surface of said first support panel extending horizontally outward past said respective second support panels, each of said second support panels having a top edge and a bottom edge configured to be positioned between an upper plate and a lower plate of the second wall section; and at least one connector bracket connected to said first support panel, wherein said at least one connector bracket is configured to secure the first support panel to at least one of the respective upper and lower plates of the first wall section, said at least one connector bracket including, a first connector member affixed to a second surface of said first support panel, a connector panel connected to and extending substantially perpendicular to said first connector member, and extending along either the top edge or bottom edge of said first support panel, and a pair of second connector members connected to and extending substantially perpendicular to said second connector panel, and configured to be secured to the respective upper plate or lower plate of the first wall section.

2. The frame of claim 1, wherein the pair of second support panels are substantially perpendicular to the single first support panel.

3. The frame of claim 1, wherein the pair of second support panels are positioned substantially parallel to one another.

4. The frame of claim 1, wherein the pair of second support panels are affixed to the single first support panel by at least one of a plurality of nails, a plurality of screws and adhesive.

5. The frame of claim 1, wherein the space between the pair of second support panels is at least one inch wide.

6. The frame of claim 1, wherein the pair of second support panels are positioned a sufficient distance from respective side edges of the first panel to allow securing of finished material to both the pair of second support panels and the adjacent surfaces of the single first support panel.

7. The frame of claim 6, wherein the pair of second panels are affixed to the single first support panel between 1 inch and 3 inches from the respective side edges of the single first panel.

8. The frame of claim 1, wherein the pair of second panels are substantially the same length, width and height.

9. The frame of claim 1, further comprising a plurality of connector brackets configured to secure the single first support panel to the upper plate and the lower plate of the first wall section.

10. The frame of claim 1, wherein the frame is prefabricated using recycled material.

11. A frame for supporting an intersection between a first wall section and a second wall section comprising:

a pair of first support panels, each having a top edge and a bottom edge configured to be positioned between respective upper and lower plates of the first wall section;

a pair of second support panels directly affixed to respective first surfaces of the pair of first support panels, each second support panel having a top edge and a bottom edge configured to be positioned between respective upper and lower plates of the second wall section; and a plurality of connector brackets configured to secure the pair of first support panels to the respective upper and lower plates of the first wall section, wherein the respective first surfaces of the pair of first support panels extend horizontally outward past the respective second support panels, and wherein one of the plurality of brackets comprises a pair of first connector members affixed to respective second surfaces of the pair of first support panels, a connector panel substantially perpendicular to the pair of first connector members and extending along either the top edge or bottom edge of the pair of first support panels, and a pair of second connector members substantially perpendicular to the second connector panel and configured to secure the pair of first support panels to the upper plate or lower plate, respectively of the first wall section.

12. The frame of claim 11, wherein the pair of second support panels are affixed substantially perpendicular to the pair of first support panels.

13. The frame of claim 11, wherein the pair of second support panels are affixed to the pair of first support panels such that the pair of second support panels are positioned substantially parallel to one another.

14. The frame of claim 11, wherein the space between the pair of second support panels is at least one inch wide.

15. The frame of claim 11, wherein the pair of second support panels are each affixed to the pair of first support panels a sufficient distance from respective outer side edges of the pair of first panels to allow securing of finished material to both the pair of second support panels and the adjacent surfaces of the pair of first support panels.

16. The frame of claim 15, wherein the pair of second panels are affixed to the pair of first panel between 1 inch and 3 inches from the respective outs side edges of the pair of first panels.

17. The frame of claim 11, wherein the pair of second panels are substantially the same length, width and height.

18. The frame of claim 11, wherein the frame is prefabricated using recycled material.

19. A frame for providing an intersection between a first wall section and a second wall section comprising:

a first support panel having a top edge and a bottom edge configured to be positioned between respective upper and lower plates of the first wall section;

a pair of second support panels directly affixed to and extending outward from a first surface of the first support panel, each second support panel having a top edge and a bottom edge configured to be positioned between respective upper and lower plates of the second wall section; and a plurality of connector brackets configured to secure the first support panel to the respective upper and lower plates of the first wall section, wherein one of the plurality of brackets comprises a first connector panel extending along and affixed to a second surface of the first support panel, a second connector panel substantially perpendicular to the first connector panel and extending along wither the top edge or the bottom edge of the first support panel, and a pair of connector members substantially perpendicular to the second connector panel and configured to secure the first support panel to the upper plate or lower plate, respectively, of the first wall section.

20. The frame of claim 9, wherein the single first support panel and the pair of second support panels are manufactured from a single piece of composite material.

21. The frame of claim 11, wherein the pair of first support panels and the pair of second support panels are manufactured from a single piece of composite material.

* * * * *